US007109935B2

(12) United States Patent
Saint Clair et al.

(10) Patent No.: US 7,109,935 B2
(45) Date of Patent: Sep. 19, 2006

(54) COMBINED OPTICAL AND ELECTROMAGNETIC COMMUNICATION SYSTEM AND METHOD

(75) Inventors: Jonathan M. Saint Clair, Seattle, WA (US); Julio A. Navarro, Kent, WA (US); Derek E. Iverson, Kent, WA (US); Scott A. Raby, Redmond, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/915,169

(22) Filed: Aug. 10, 2004

(65) Prior Publication Data

US 2006/0033663 A1 Feb. 16, 2006

(51) Int. Cl.
*H01Q 21/00* (2006.01)
*H01Q 13/00* (2006.01)

(52) U.S. Cl. ..... 343/725; 343/781 CA

(58) Field of Classification Search ..... 343/725, 343/781 CA
See application file for complete search history.

(56) References Cited

U.S. PATENT DOCUMENTS

| | | | | |
|---|---|---|---|---|
| 2,972,743 | A * | 2/1961 | Svensson et al. | 343/838 |
| 4,282,527 | A | 8/1981 | Winderman et al. | 343/725 |
| 4,477,814 | A | 10/1984 | Brumbaugh et al. | 343/725 |
| 5,034,997 | A | 7/1991 | Iwasaki | 398/115 |
| 5,214,438 | A | 5/1993 | Brusgard et al. | 343/725 |
| 5,268,680 | A * | 12/1993 | Zantos | 342/53 |
| 5,327,149 | A | 7/1994 | Kuffer | 343/720 |
| 5,451,969 | A * | 9/1995 | Toth et al. | 343/781 CA |
| 5,479,595 | A | 12/1995 | Israelsson | 398/115 |
| 6,049,593 | A | 4/2000 | Acampora | 398/119 |
| 6,225,955 | B1 * | 5/2001 | Chang et al. | 343/720 |
| 6,285,481 | B1 | 9/2001 | Palmer | 343/781 CA |
| 6,307,521 | B1 | 10/2001 | Schindler et al. | 379/56.2 |
| 6,343,766 | B1 * | 2/2002 | Livingston | 244/3.13 |
| 6,417,807 | B1 * | 7/2002 | Hsu et al. | 343/700 MS |
| 2005/0109879 | A1 * | 5/2005 | Patterson | 244/172 |

FOREIGN PATENT DOCUMENTS

WO WO 02/32020 4/2002

OTHER PUBLICATIONS

Patent application entitled: "Lenslet/Dector Array Assembly for High Data Rate Optical Communications", U.S. Appl. No. 10/961,173, filed Oct. 8, 2004.

(Continued)

*Primary Examiner*—Tho Phan
(74) *Attorney, Agent, or Firm*—Harness Dickey & Pierce P.L.C.

(57) ABSTRACT

An antenna system for communicating electromagnetic and optical signals using a common aperture is provided. The system includes at least one optical phased array terminal integrated with an optically transparent electromagnetic antenna such that the optically transparent electromagnetic antenna and the optical phased array terminal share a common aperture. The optically transparent electromagnetic antenna includes a substrate fabricated of a substantially electrically non-conductive material that is substantially optically transparent to optical signals having a wavelength within a specific portion of the optical spectrum. An antenna element layer, including an array of electromagnetic antenna elements electrically connected by transmission lines and a plurality of phase shifters electrically connected to the electromagnetic antenna elements is disposed onto the substrate. The antenna elements and the transmission lines are fabricated of a conductive material that is deposited such that they are substantially optically transparent to optical signals having a wavelength within the specific portion of the optical spectrum.

25 Claims, 3 Drawing Sheets

OTHER PUBLICATIONS

Patent application entitled: "Hybrid RF/Optical Communication System with Deployable Optics and Atmosphere Compensation System and Method," filed Jul. 6, 2004.

"New Paint Compounds Provide Early Detection of Corrosion to Aircraft", AFOSR; Research Highlights Serial No. 10,885,553, Jul./Aug. 1999.

Tao, et al. "Wideband fully differential CMOS transimpedance preamplifier," Electronics Letters 39(21); Oct. 16, 2003; 2 pages.

Oh, et al. "A 2.5 Gb/s CMOS Transimpedance Amplifier Using Novel Active Inductor Loan, " 27th European Solid-State Circuits Conference, Villach, Austria, Sep. 18-20, 2001.

Ambundo, et al. "Fully Integrated Current-Mode Subaperture Centroid Circuits and Phase Reconstructor," 10th NASA Symp. VLSI Design, Albuquerque, NM Mar. 2002.

Rienstra, J.L. and Ballard, M., "MTI focal plane assembly design and performance," 13 pages, dated Jun. 30, 1999.

* cited by examiner

COMBINED OPTICAL AND ELECTROMAGNETIC COMMUNICATION SYSTEM AND METHOD

FIELD OF INVENTION

The invention relates generally to mobile platform communication systems. More specifically, the invention relates to combined optical and electromagnetic antenna systems that utilize a common aperture to transmit and receive both optical and electromagnetic signals.

BACKGROUND OF THE INVENTION

Broadband communication access, on which our society and economy is growing increasingly dependent, is becoming more readily available to users on board mobile platforms such as aircraft, buses, ships, trains and automobiles. Typically, mobile platform communications systems that provide such access utilize electromagnetic communication signals, also generally referred to in the art as radio frequency (RF) signals, to communicate with a remote, typically ground based, system. To increase available bandwidth, some known mobile platform communication systems have implemented optical, i.e. laser, communication systems in addition to the electromagnetic systems.

Generally, known communication systems for mobile platforms that provide both optical/laser and electromagnetic modes of communication require separate optical and electromagnetic apertures. Thus, such systems generally include at least one optical terminal and at least one separate electromagnetic antenna mounted on the mobile platform. However, separate optical and electromagnetic apertures/antennas add additional equipment costs, add significant weight and occupy valuable space which may not be available on a given mobile platform.

Commonly, combined communication systems utilize satellite dishes, phased arrays and telescopes to provide for the communication of both optical and electromagnetic signals. For example, at least one known system includes a small planar electronically scanned electromagnetic phased array antenna and at least one separate optical phased array (OPA) terminal. However, the phased array antenna and the OPA must be implemented separately and care must be taken to implement both systems such that each performs to expectation at the expense of increased physical space consumption. Additionally, when separate optical and electromagnetic systems, specifically the optical terminals and electromagnetic antennas, are mounted on the mobile platform in close proximity, alignment and calibration become difficult to optimize. Therefore, set-up of such systems can be very time consuming and performance often inhibited.

Therefore, it would be desirable to add additional communications bandwidth by adding optical communications to a mobile platform communications system while minimizing the footprint of the exterior communications equipment, e.g. antenna and related electronics, on the mobile platform.

BRIEF SUMMARY OF THE INVENTION

In one preferred implementation of the present invention an antenna system for communicating electromagnetic and optical signals using a common aperture is provided. The system includes at least one optical phased array terminal integrated with an optically transparent electromagnetic antenna such that the optically transparent electromagnetic antenna and the optical phased array terminal share a common aperture. The optically transparent electromagnetic antenna includes a substrate fabricated of a substantially non-conductive material that is substantially optically transparent to optical signals having a wavelength within a specific portion of the optical spectrum. An antenna element layer, including an array of electromagnetic antenna elements electrically connected by transmission lines and a plurality of phase shifters electrically connected to the electromagnetic antenna elements is disposed onto the substrate. The antenna elements and the transmission lines are fabricated of a conductive material that is deposited such that they are substantially optically transparent to optical signals having a wavelength within the specific portion of the optical spectrum. The phase shifters are fabricated of a semiconductor material that may or may not be transparent to optical signals.

The optically transparent electromagnetic antenna further includes various other layers. For example the optically transparent electromagnetic antenna may also include a ground plane layer and additionally layers for data, clock and a power distribution. Each of the layers is independently fabricated of a conductive material that is optically transparent to optical signals having a wavelength within the specific portion of the optical spectrum.

The features, functions, and advantages of the present invention can be achieved independently in various embodiments or may be combined in yet other embodiments.

BRIEF DESCRIPTION OF THE DRAWINGS

The present invention will become more fully understood from the detailed description and accompanying drawings, wherein.

Corresponding reference numerals indicate corresponding parts throughout the several views of drawings.

DETAILED DESCRIPTION OF THE INVENTION

The following description of the preferred embodiments is merely exemplary in nature and is in no way intended to limit the invention, its application or uses. Additionally, the advantages provided by the preferred embodiments, as described below, are exemplary in nature and not all preferred embodiments provide the same advantages or the same degree of advantages.

Figure 1:
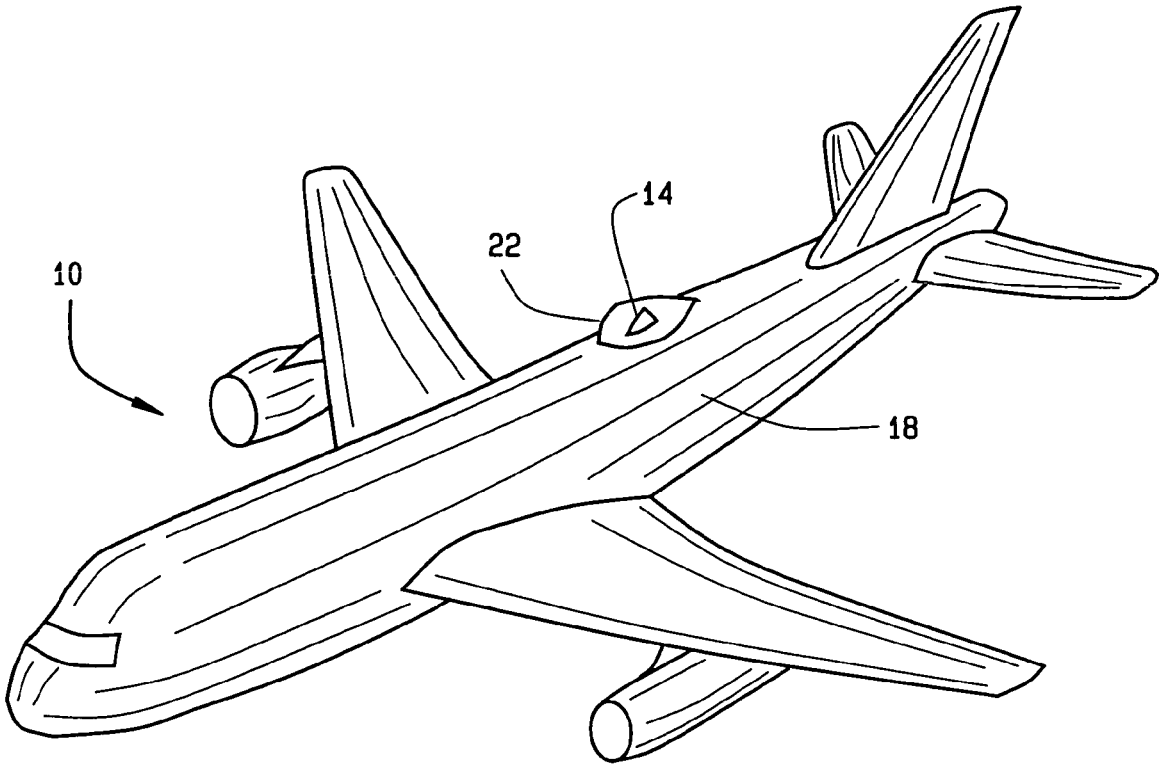
FIG. 1 is an illustration of an antenna assembly mounted on a mobile platform communications system, in accordance with one preferred embodiment of the present invention.

FIG. 1 is an illustration of a mobile platform 10 including an antenna assembly 14. Although the mobile platform 10 is shown as an aircraft, the mobile platform 10 could also be represented in the form of other mobile platforms, such as a ship, a train, a bus or an automobile. The exemplary embodiment shown in FIG. 1 illustrates the antenna assembly 14 mounted to the exterior of a fuselage 18 of the mobile platform 10 and covered by a shroud 22. In the case that the mobile platform 10 is an aircraft, the shroud 22 is commonly referred to as a radome. The antenna assembly 14 is part of a mobile platform communication system that also includes various other communication system components (not shown), such as a server, a processor, electronic storage devices, etc., located within an interior of the mobile platform 10.

Figure 2:
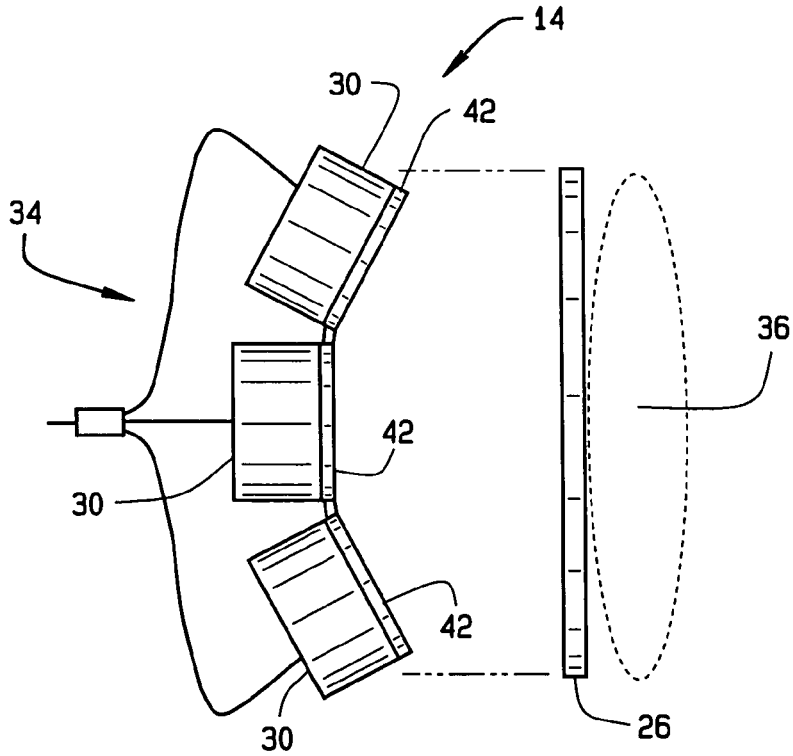
FIG. 2 is an exploded side view of the antenna assembly, shown in FIG. 1, in accordance with a preferred embodiment of the present invention.
Figure 3:
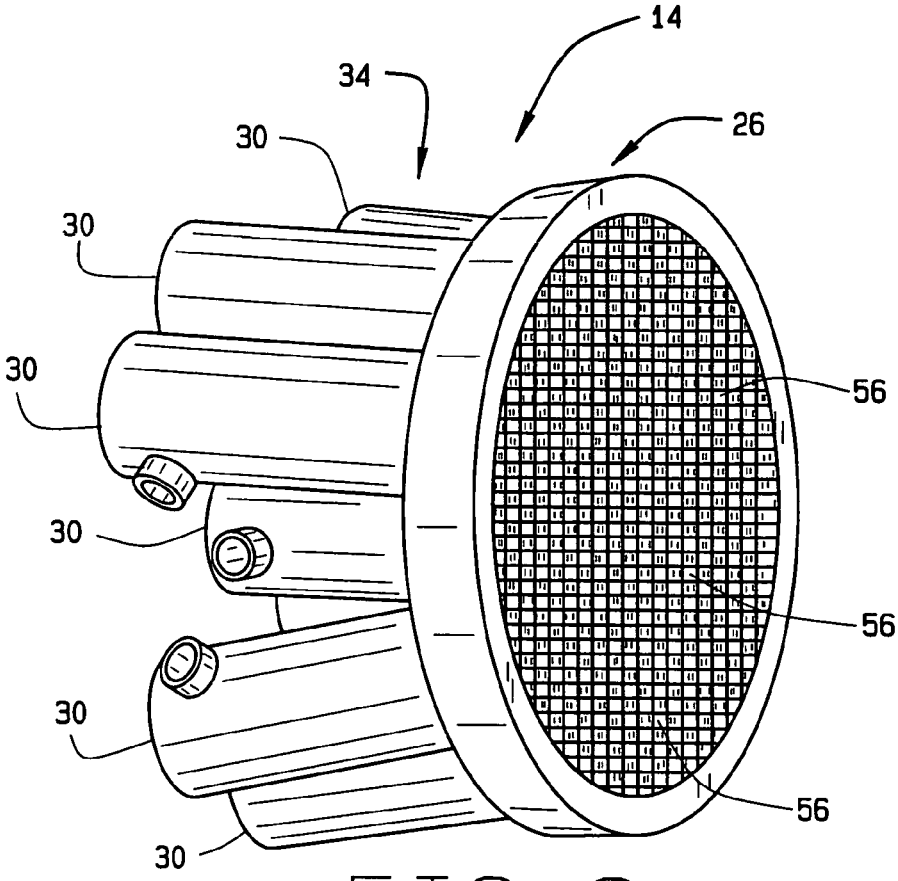
FIG. 3 is a perspective view of the antenna assembly, shown in FIG. 1, in accordance with a preferred embodiment of the present invention.

FIGS. 2 and 3, respectively, illustrate an exploded side view and perspective view of the antenna assembly 14 in accordance with a preferred embodiment of the present invention. The antenna assembly 14 includes an optically transparent electromagnetic antenna 26 integrated with at least one optically phased array terminal 30. FIGS. 2 and 3 illustrate the optically transparent electromagnetic antenna 26 integrated with an array 34 that includes a plurality of optically phased array terminals 30. The optically transparent electromagnetic antenna 26 is integrated with the optically phased array terminal(s) 30 such that the optically transparent electromagnetic antenna 26 and the optical phased array terminal(s) 30 share a common aperture 36.

Electromagnetic antennas, such as the optically transparent electromagnetic antenna 26, are often generally referred to in the art as radio frequency (RF) antennas. The optically transparent electromagnetic antenna 26 is not restricted to use with RF signals, but is adapted for transmission and/or receipt of electromagnetic signals of other wavelengths, for example microwave signals. Generally, the optically transparent electromagnetic antenna 26 could transmit and/or receive signals having wavelengths between 2 GHz and 120 GHz. Thus, for convenience and clarity, the optically transparent electromagnetic antenna 26 will be referred to herein as the OT antenna 26. In a preferred embodiment, the OT antenna 26 is an optically transparent planar electronically scanned phased array antenna. For additional convenience and clarity, the optically phased array terminal(s) 30 will be referred to herein as the OPA terminal(s) 30.

Figure 4:
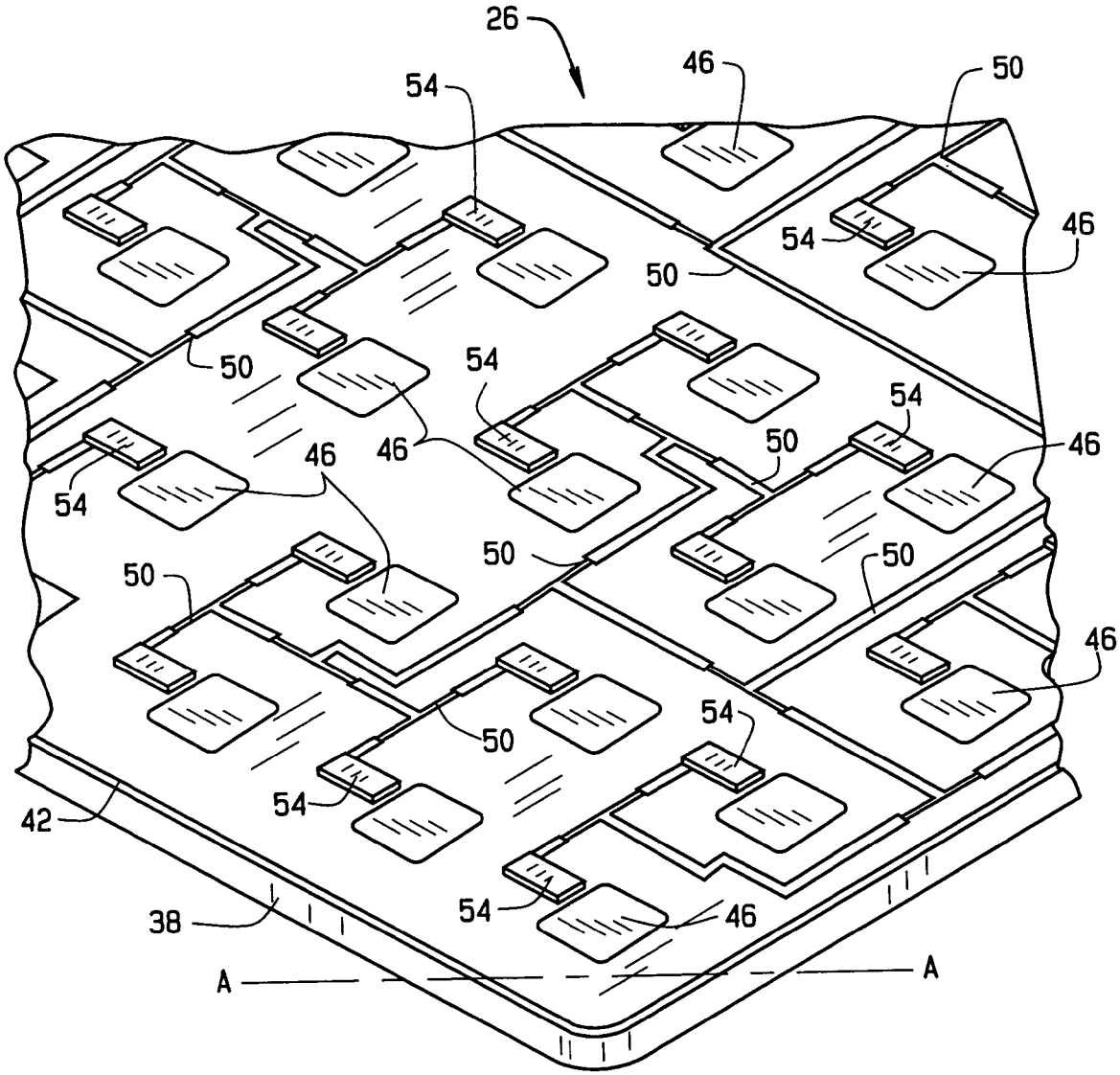
FIG. 4 is an illustration of the optically transparent antenna shown in FIG. 2.

FIG. 4 is an illustration of a portion of the OT antenna 26 including a substrate 38 having an antenna element layer 42. The substrate 38 is fabricated of a substantially electrically non-conductive material that is optically transparent to optical, e.g. laser, signals having a wavelength within a specific portion of the optical spectrum. For example, the substrate could be optically transparent to optical signals having a wavelength between 1.0 μm and 2.0 μm. Alternatively, the substrate could be optically transparent to optical signals in various other optical bands, such as the Visible-Near Infrared, the Mid-Wave Infrared or Long Wave Infrared wavelength bands. The substrate 38 is fabricated from a dichroic material such as glass, quartz or any other material that has good electromagnetic properties, e.g. low loss tangent, good isotropic quality, temperature stability and is amenable to printed circuit manufacturing. The antenna element layer 42 is disposed on the substrate 38 using any suitable method, for example vapor disposition, lithography or any other coating approach known in the art.

The antenna element layer 42 includes a plurality of antenna elements 46 arranged and electrically connected by transmission lines 50 to form an array. The antenna elements 46 are polarized antenna elements. Particularly the antenna elements 46 can be left-hand, right-hand or linearly polarized. The transmission lines 50 are preferably fabricated to match the impedances of the antenna elements 46 to an array input impedance, e.g. 50 ohms. Additionally, in a preferred implementation, the antenna element layer 42 includes phase shifters 54, for example, microwave monolithic integrated circuit (MMIC) phase shifters, electrically connected to each antennal element 46 to provide electronic scanning for the OT antenna 26. In a preferred embodiment, the phase shifters 54 provide up to plus or minus fifty degrees of scan performance. The antenna layer 42, e.g. antenna elements 46 and the transmission lines 50 are fabricated of an optically transparent electrically conductive material deposited on the optically transparent substrate 38. For example, the antenna elements 46 and the transmission lines 50 can be fabricated from Indium Tin Oxide, gold arranged in a grid, or any other material that has good electrical conductive properties such as high conductive loss resistivity and can be deposited onto the substrate 38. The phase shifters 54 can be fabricated using standard semiconductors, e.g. silicon germanium or gallium arsenide, and mounted on the substrate 38 by non-conducting epoxy glue. As shown in FIGS. 2 and 3, the OT antenna 26 is mounted on top of the OPA terminal(s) 30 so that the OT antenna 26 has substantially the same aperture 36 as the OPA terminal(s) 30. By sharing a common aperture 36, the antenna assembly 14 provides both optical and electromagnetic communication for the mobile platform 10 without consuming additional space on the fuselage 18.

In a preferred implementation, the antenna elements 46 are gold deposited onto the substrate 38 in a rectilinear grid or mesh using lithography. That is, the antenna elements 46 are not solid, but form a screen-like element. Although, the rectilinear grid of the antenna elements 46 is not shown in FIG. 4, it should be understood that, for this embodiment, if each antenna element 46 were significantly enlarged, each antennal element 46 would be seen as comprising a grid or mesh. Therefore, optical signals to or from the array 34 of OPA terminals 30 are allowed to pass through a plurality of openings 56 in the grid, generally illustrated in FIG. 3. Optimal operation of the antenna assembly 14 for both the optical and electromagnetic performance is based on the design parameters of the grid. More specifically, there is a trade-off between optical and electromagnetic performance depending on the specification of the grids that form the antenna elements 46. The size of the openings 56 is determined based on the frequency of the optical signals desired to pass through the grid. The tighter the grid, i.e. the smaller the openings 56 in the grid, the smaller the wavelength of the optical signals must be to pass through. Thus, fewer optical signals will be able to be transmitted and/or received. Therefore, the lower the optical efficiency of the antenna assembly 14 will be because the metal will block the greater amount of optical signals. However, the wider the grid, i.e. the larger the openings 56 in the grid, the larger the optical signals wavelengths can be and pass through the grid. Thus, a larger range of optical signals can be transmitted and/or received. Therefore, the more diminished the electromagnetic performance will be. Thus, the design specification of the metal grid antenna elements 46 can vary based on the desired optimal performance of the antenna assembly 14. Alternatively, the antenna elements 46 could be deposited on the substrate 38 as an optically transparent solid metal, e.g. Indium Tin Oxide.

Figure 5:
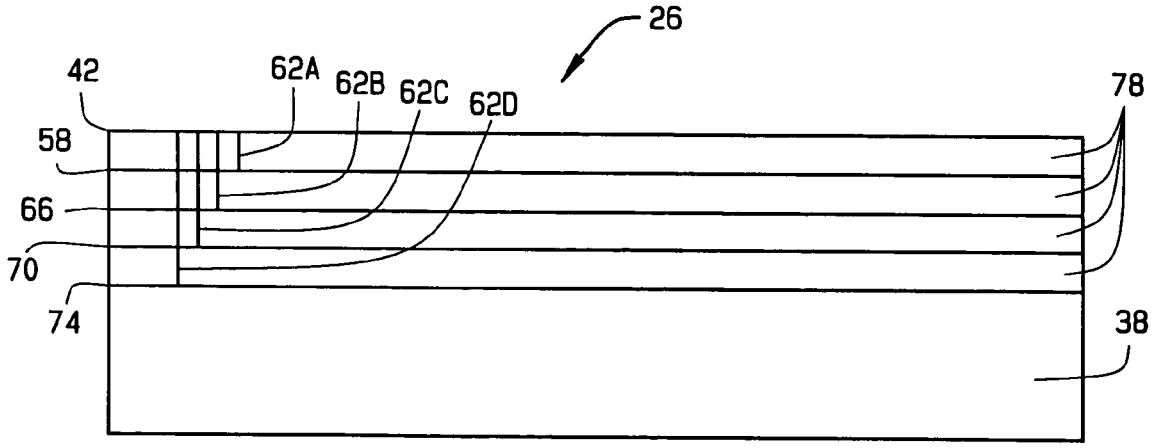
FIG. 5 is an enlarged cross sectional view of the optically transparent antenna, shown in FIG. 2.

FIG. 5 is a cross sectional view of the OT antenna 26 along the line A—A, shown in FIG. 4. The OT antenna 26 includes a plurality of other layers that provide such things as power, clocking, data transmission and grounding to the OT antenna 26. FIG. 5 illustrates an exemplary embodiment of the OT antenna having five layers. It should be understood that the five layers shown are exemplary and that the OT antenna 26 could include more layers or fewer layers and remain within the scope of the invention. Additionally, the location of individual layers may vary and is not exclusive to that shown in FIG. 5. Each of the layers of the OT antenna 26 is independently fabricated from electrically conductive optically transparent material, e.g. Indium Tin Oxide or gold arranged in a grid. That is, each layer is fabricated from an optically transparent material, such that all the layers are fabricated from the same optically transparent material, or the optically transparent material used to fabricate each layer may vary from one layer to the next. Furthermore, a single layer may be fabricated from more than one optically transparent material.

As illustrated in FIG. 5, in a preferred embodiment the OT antenna 26 also includes a ground plane layer 58 electrically connected to the antenna element layer 42 via a vertical connector 62A. The ground plane layer 58 is fabricated from an electrically conductive material deposited onto the substrate 38 using any suitable method, e.g. vapor disposition, lithography or any other coating approach known in the art. The electrically conductive material is optically transparent to optical signals having a wavelength within the same portion of the optical spectrum as the antenna element layer 42 and the substrate 38. The OT antenna 26 illustrated in FIG. 5, further includes a data layer 66 electrically connected to the antenna element layer 42 via a vertical connector 62B. The data layer 66 is fabricated from an electrically conductive material deposited onto the substrate 38 using any suitable method, e.g. vapor disposition, lithography or any other coating approach known in the art. The electrically conductive material is optically transparent to optical signals having a wavelength within the same portion of the optical spectrum as the antenna element layer 42, the ground plane layer 58 and the substrate 38. The data layer 66 includes data lines distributed to each phase shifter 54.

Further yet, the OT antenna 26 illustrated in FIG. 5 includes a clock layer 70 electrically connected to the antenna element layer 42 via a vertical connector 62C. The clock layer 70 is fabricated from an electrically conductive material deposited onto the substrate 38 using any suitable method, e.g. vapor disposition, lithography or any other coating approach known in the art. The electrically conductive material is optically transparent to optical signals having a wavelength within the same portion of the optical spectrum as the antenna element layer 42, the ground plane layer 58, the data layer 66 and the substrate 38. The clock layer 70 includes clock lines distributed to each phase shifter 54. Still further yet, the OT antenna 26 illustrated in FIG. 5 includes a power layer 74, e.g. a DC power layer, electrically connected to the antenna element layer 42 via a vertical connector 62D. The power layer 74 is fabricated from an electrically conductive material deposited onto the substrate 38 using any suitable method, e.g. vapor disposition, lithography or any other coating approach known in the art. The electrically conductive material is optically transparent to optical signals having a wavelength within the same portion of the optical spectrum as the antenna element layer 42, the ground plane layer 58, the data layer 66, the clock layer 70 and the substrate 38. The power layer 74 includes power lines distributed to each phase shifter 54.

Between each of the layers 42, 58, 66, 70 and 74 is a dichroic layer 78 fabricated from an optically transparent dichroic material, for example a polyimide, a vapor deposited silica spacer, an optically transparent epoxy, Mylar™ film, glass or quartz. The dichroic material is optically transparent to optical signals having a wavelength within the same portion of the optical spectrum as the antenna element layer 42, the ground plane layer 58, the data layer 66, the clock layer 70, the power layer 74 and the substrate 38. The thicknesses of the dichroic layers 78 are variable based on processing and design requirements of the OT antenna 26

As described above, the OT antenna 26 and the OPA terminal(s) 30 share a common aperture 36. Specifically, optical signals to and from the OPA terminal(s) 30 pass through the same aperture 36 as electromagnetic signals to and from the OT antenna 26. Therefore, optical signals to and from the OPA terminal(s) 30 must also pass through the OT antenna 26. The optically transparent material(s) used to fabricate the various components and layers of the OT antenna 26 allow the optical signals to pass through the OT antenna 26 with minimal loss. Electromagnetic signals are transmitted or received by energizing the various components and layers of the OPA antenna 26, described above, without interference from the OPA terminal(s) 30. In a preferred embodiment, a separate transmit antenna assembly 14 and a separate receive antenna assembly 14 are employed by the mobile platform communication system. In this embodiment, the transmit antenna assembly 14 is described above with reference to FIGS. 4 and 5. However, the OT antenna 26 of the receive antenna assembly 14 would further include a plurality of low noise amplifier (LNA) components (not shown) electrically connected to the antenna elements 46. Additionally, a second power layer (not shown) would be required to provide power to each LNA component.

In an alternate preferred embodiment, a single antenna assembly 14 is utilized for both transmitting and receiving optical and electromagnetic signals. In this embodiment, the single antenna assembly 14 would include the LNA components, a transmit/receive switch and the second power layer, as described above.

The present invention provides an optically transparent electromagnetic antenna 26 integrated with, e.g. placed over, an array 34 of optical phased array terminals 30. Thus, a completely integrated electromagnetic/optical phased array antenna is provided that requires minimal space to install and utilizes a common aperture.

While the invention has been described in terms of various specific embodiments, those skilled in the art will recognize that the invention can be practiced with modification within the spirit and scope of the claims.

What is claimed is:

1. An optically transparent electromagnetic antenna comprising:

a substrate that is optically transparent to optical signals having a wavelength within a specific portion of the optical spectrum; and an antenna element layer comprising an array of electromagnetic antenna elements fabricated of an electrically conductive material deposited onto the substrate such that the antenna elements are substantially optically transparent to optical signals having a wavelength within the specific portion of the optical spectrum;

wherein the optically transparent electromagnetic antenna is adapted to be integrated with at least one optical terminal such that the optically transparent electromagnetic antenna and the optical terminal share a common aperture.

2. The antenna of claim 1, wherein the antenna further comprises a ground plane layer electrically connected to the antenna element layer, the ground plane layer comprising an electrically conductive material deposited onto the substrate such that the ground plane layer is substantially optically transparent to optical signals having a wavelength within the specific portion of the optical spectrum.

3. The antenna of claim 1, wherein the antenna further comprises a data layer electrically connected to the antenna element layer, the data layer comprising an electrically conductive material deposited onto the substrate such that the data layer is substantially optically transparent to optical signals having a wavelength within the specific portion of the optical spectrum.

4. The antenna of claim 1, wherein the antenna further comprises a clock layer electrically connected to the antenna element layer, the clock layer comprising an electrically conductive material deposited onto the substrate such that the clock layer is substantially optically transparent to optical signals having a wavelength within the specific portion of the optical spectrum.

5. The antenna of claim 1, wherein the antenna further comprises a power layer electrically connected to the antenna element layer, the power layer comprising an electrically conductive material deposited onto the substrate such that the power layer is substantially optically transparent to optical signals having a wavelength within the specific portion of the optical spectrum.

6. The antenna of claim 1, wherein the electrically non-conductive material of the substrate comprises quartz.

7. The antenna of claim 1, wherein the array of electromagnetic antenna elements comprises a plurality of electromagnetic antenna elements electrically connected by transmission lines, wherein the electromagnetic antenna elements and the transmission lines are fabricated of the optically transparent electrically conductive material deposited onto the substrate.

8. The antenna of claim 7, wherein the electrically conductive material of the antenna elements comprises gold arranged in a grid.

9. The antenna of claim 7, wherein the electrically conductive material of the antenna elements comprises Indium Tin Oxide.

10. The antenna of claim 7, wherein the antenna element layer further comprises a plurality of phase shifters electrically connected to the electromagnetic antenna elements to provide electronic scanning, wherein the phase shifters are bonded to the substrate.

11. A method for providing electromagnetic and optical communication to and from a mobile platform, said method comprising:

providing an optically transparent electromagnetic antenna mounted to an exterior of a mobile platform, the optically transparent electromagnetic antenna including a substrate fabricated of a substantially electrically non-conductive material that is optically transparent to optical signals having a wavelength within a specific portion of the optical spectrum;

providing at least one optical phased array terminal mounted to the exterior of the mobile platform; and overlaying the optically transparent electromagnetic antenna on top of the optical phased array terminal so that the optically transparent electromagnetic antenna and the optical phased array terminal share a common aperture.

12. The method of claim 11, wherein providing the optically transparent electromagnetic antenna comprises constructing the optically transparent electromagnetic antenna to include an antenna element layer comprising an array of electromagnetic antenna elements fabricated of an electrically conductive material deposited onto the substrate such that the antenna elements are substantially optically transparent to optical signals having a wavelength within the specific portion of the optical spectrum.

13. The method of claim 12, wherein providing the optically transparent electromagnetic antenna comprises connecting the electromagnetic antenna elements with a plurality of transmission lines deposited onto the substrate such that the transmission lines are substantially optically transparent to optical signals having a wavelength within the specific portion of the optical spectrum.

14. The method of claim 13, wherein providing the optically transparent electromagnetic antenna comprises constructing the optically transparent electromagnetic antenna to include the antenna element layer further comprising a plurality of phase shifters electrically connected to the electromagnetic antenna elements to provide electronic scanning, wherein the phase shifters are deposited onto the substrate.

15. The method of claim 14, wherein providing the optically transparent electromagnetic antenna comprises fabricating the substrate and the electromagnetic antenna elements to be substantially optically transparent to optical signals having a wavelength in at least one of a visible-near infrared optical band, a mid-wave infrared optical band and a long wave infrared optical band.

16. The method of claim 12, wherein providing the optically transparent electromagnetic antenna comprises fabricating the antenna elements from gold arranged in a grid.

17. The method of claim 12, wherein providing the optically transparent electromagnetic antenna comprises fabricating the antenna elements from Indium Tin Oxide.

18. The method of claim 11, wherein providing the optically transparent electromagnetic antenna comprises constructing the optically transparent electromagnetic antenna to include a ground plane layer electrically connected to the antenna element layer, the ground plane layer comprising an electrically conductive material deposited onto the substrate such that the ground layer is substantially optically transparent to optical signals having a wavelength within the specific portion of the optical spectrum.

19. The method of claim 11, wherein providing the optically transparent electromagnetic antenna comprises constructing the optically transparent electromagnetic antenna to include a data layer electrically connected to the antenna element layer, the data layer comprising an electrically conductive material deposited onto the substrate such that the data layer is substantially optically transparent to optical signals having a wavelength within the specific portion of the optical spectrum.

20. The method of claim 11, wherein providing the optically transparent electromagnetic antenna comprises constructing the optically transparent electromagnetic antenna to include a clock layer electrically connected to the antenna element layer, the clock layer comprising an electrically conductive material deposited onto the substrate such that the clock layer is substantially optically transparent to optical signals having a wavelength within the specific portion of the optical spectrum.

21. The method of claim 11, wherein providing the optically transparent electromagnetic antenna comprises constructing the optically transparent electromagnetic antenna to include a power layer electrically connected to the antenna element layer, the power layer comprising an electrically conductive material deposited onto the substrate such that the power layer is substantially optically transparent to optical signals having a wavelength within the specific portion of the optical spectrum.

22. An antenna system for communicating electromagnetic and optical signals using a common aperture, said system comprising at least one optical phased array terminal; and an optically transparent electromagnetic antenna integrated with the optical phased array terminal such that the optically transparent electromagnetic antenna and the optical phased array terminal share a common aperture, wherein the optically transparent electromagnetic antenna comprises:

a substrate fabricated of a substantially electrically non-conductive material that is optically transparent to optical signals having a wavelength within a specific portion of the optical spectrum;

an antenna element layer comprising an array of electromagnetic antenna elements electrically connected by transmission lines and a plurality of phase shifters electrically connected to the electromagnetic antenna elements to provide electronic scanning, wherein the antenna elements and the transmission lines are fabricated of an electrically conductive material deposited onto the substrate such that the transmission lines are substantially optically transparent to optical signals having a wavelength within the specific portion of the optical spectrum;

a ground plane layer electrically connected to the antenna element layer, the ground plane layer comprising an electrically conductive material deposited onto the substrate such that the ground layer is substantially optically transparent to optical signals having a wavelength within the specific portion of the optical spectrum;

a data layer electrically connected to the antenna element layer, the data layer comprising an electrically conductive material deposited onto the substrate such that the data layer is substantially optically transparent to optical signals having a wavelength within the specific portion of the optical spectrum;

a clock layer electrically connected to the antenna element layer, the clock layer comprising an electrically conductive material deposited onto the substrate such that the clock layer is substantially optically transparent to optical signals having a wavelength within the specific portion of the optical spectrum; and a power layer electrically connected to the antenna element layer, the power layer comprising an electrically conductive material deposited onto the substrate such that the power layer is substantially optically transparent to optical signals having a wavelength within the specific portion of the optical spectrum.

23. The system of claim 22, wherein the substrate comprises a quartz substrate.

24. The system of claim 22, wherein the electrically conductive material of each of the layers independently comprises at least one of gold arranged in a grid, and Indium Tin Oxide.

25. The system of claim 22, wherein the phase shifters bonded to the substrate.

* * * * *